United States Patent [19]

Parsons et al.

[11] 4,205,756

[45] Jun. 3, 1980

[54] CONTAINER

[75] Inventors: James D. Parsons, Munster, Ind.; Richard D. Mehring, Akron, Ohio

[73] Assignee: Union Tank Car Company & Goodyear Aerospace Corporation, Lincolnshire, Ill.

[21] Appl. No.: 932,819

[22] Filed: Aug. 10, 1978

[51] Int. Cl.[2] ..... B65D 87/16; B65D 25/06

[52] U.S. Cl. ..... 220/22; 220/85 B; 222/386.5

[58] Field of Search ..... 220/20, 22, 85 B; 222/386.5

[56] References Cited

U.S. PATENT DOCUMENTS

| | | | |
|---|---|---|---|
| 2,884,978 | 5/1959 | Grimm | 220/85 B |
| 3,502,204 | 3/1970 | Paton | 220/85 B |

FOREIGN PATENT DOCUMENTS

| | | | |
|---|---|---|---|
| 2724221 | 12/1977 | Fed. Rep. of Germany | 220/85 B |

*Primary Examiner*—George E. Lowrance
*Attorney, Agent, or Firm*—Joel E. Siegel; Charles M. Kaplan

[57] ABSTRACT

A flexible diaphragm can be moved to line opposite surfaces of a vehicle container so that incompatible fluids alternately can be transported in the vehicle without the need for cleaning it. The edge of the diaphragm may be held against the inside surface of the vehicle container by a clamp. The terminal edge of the diaphragm contacts an abutment around its entire periphery. The clamp extends over the diaphragm terminal edge and the abutment.

9 Claims, 4 Drawing Figures

CONTAINER

BACKGROUND OF THE INVENTION

This invention relates to the storage of fluids, and more particularly to wheeled vehicles for transporting two different liquids in a given container.

When a tank truck or a railroad tank car transporting a particular gas or liquid is to be used to transport a different non-compatible fluid, it is necessary to clean the container of the vehicle. This is usually expensive and inconvenient, and the required specialized cleaning facilities frequently are not available. To solve this problem, it has been proposed that vehicles for transporting fluids be provided with a pair of separate inlets and outlets and a flexible diaphragm that alternately lines opposed sides of the vehicle's container. Movement of the diaphragm to line one side of the container provides a chamber for one fluid, and movement of the diaphragm to the opposite side of the container provides a chamber for a different non-compatible fluid. Thus, the container does not have to be cleaned to enable the vehicle to transport either of such fluids. However, there has not been any significant use of such vehicles having a diaphragm that enables them to alternately carry non-compatible fluids without being cleaned in between. One reason such vehicles have not been used has been the lack of a satisfactory clamping arrangement that prevents leakage of a fluid between the diaphragm and container and for ensuring that the diaphragm will not tear or be pulled loose from the container.

OBJECTIVES OF THE INVENTION

Accordingly, it is an object of this invention to provide improved means for transportation or storing non-compatible liquids.

Another object is to provide vehicles with clamped diaphragms that do not leak as a result of improper location of the terminal edge of such diaphragms.

Another object is to provide an improved way of using a mastic to hermetically seal a flexible diaphragm against a container wall surface.

Another object is to provide means for locating and sealing different sized diaphragms with enlarged end beads of differing size or shape.

Another object is to provide a way of clamping a diaphragm to a tank wall in which the diaphragm is protected from sharp surfaces.

Another object is to provide for the sealing of a flexible diaphragm against a container wall that has surface irregularities.

Another object is to provide a relatively inexpensive, durable, easily maintained railroad tank car with a flexible diaphragm sealed against the inside surface of its container that does not possess defects found in similar prior art tank cars.

Other objects and advantages of the invention will be apparent from the specification and claims, and the scope of the invention will be pointed out in the claims.

DESCRIPTION OF THE INVENTION

Figure 1:
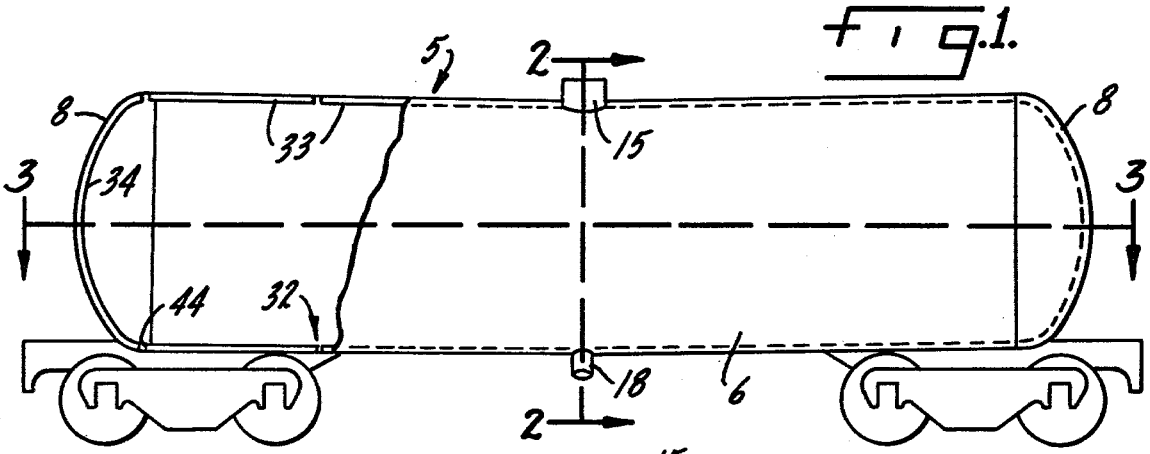
FIG. 1 is a schematic, partially, broken-away side view of a railroad tank car in accord with this invention.

The drawing shows a railroad tank car 5 including a metal tank 6 for containing and transporting alternately two different non-compatible liquids, such as lube oil and diesel oil. Container tank 6 is generally cylindrical, and has a generally horizontal longitudinal axis; its ends are closed by dished heads 8. Tank 6 encloses a diaphragm 9 made from a flexible material having an integral enlarged bead 10 defining a terminal edge 11 extending around its entire periphery. A pair of manways 14 and 15 including conventional liquid inlets are located adjacent the upper surface of tank 6 on opposite sides of its longitudinal center, and a pair of conventional liquid outlets 17 and 18 are located adjacent the lower surface of tank 6 on opposite sides of its longitudinal center. Car 5 should be provided with other necessary conventional components and accessories, such as trucks, draft gear and gauges which do not form part of the present invention.

Figure 2:
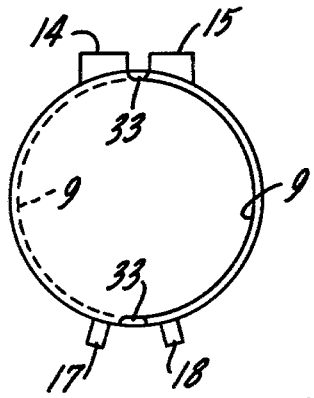
FIG. 2 is a cross sectional view taken along the line 2—2 in FIG. 1.
Figure 3:
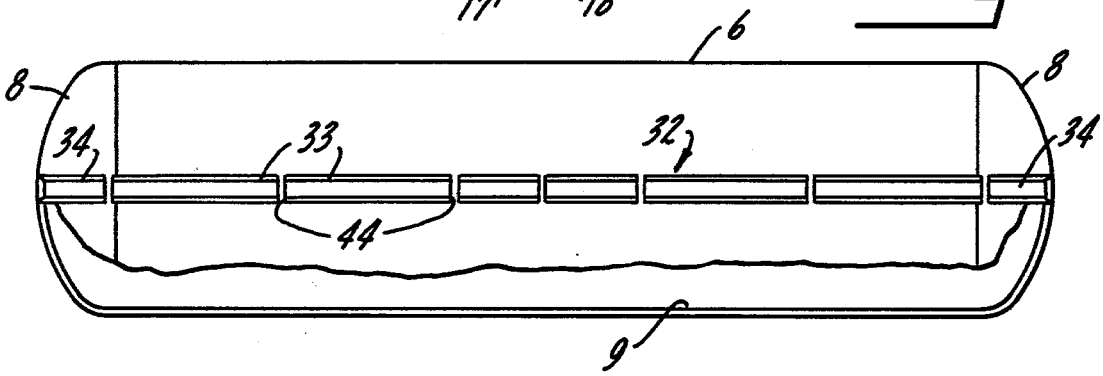
FIG. 3 is a cross sectional view taken along the line 3—3 in FIG. 1, showing the diaphragm in the position in FIG. 2, with an alternate phantom line showing.
Figure 4:
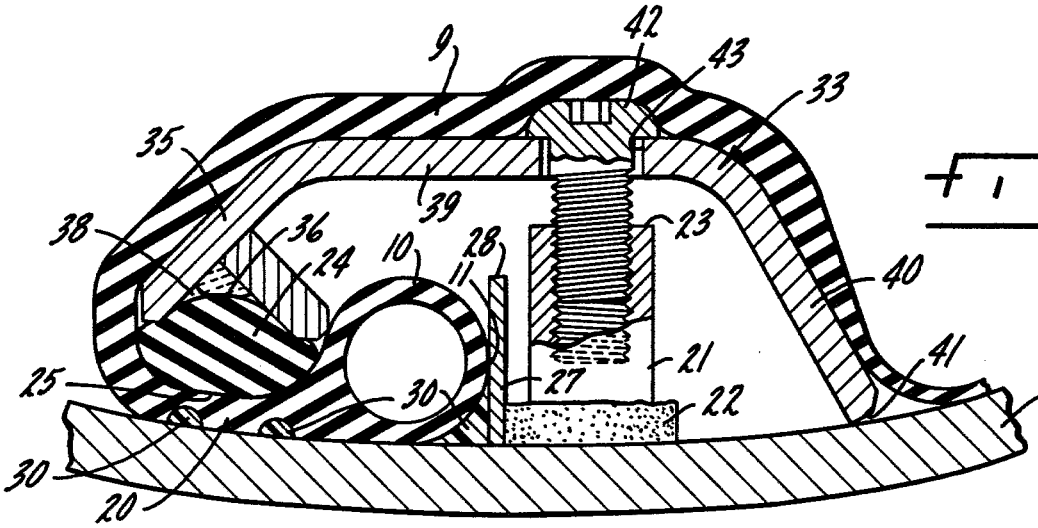
FIG. 4 is an enlargement of the cross sectional view of the clamp shown in FIG. 2.

When tank 6 is filled with a specific liquid through the inlet in manway 14, diaphragm 9 will lie against the inside wall surface of tank 6 and define a chamber for such liquid, as shown in solid lines in FIG. 2; such liquid would be drained through outlet 17. When tank 6 is filled with a non-compatible liquid through the inlet in manway 18, diaphragm 9 will be against the inside wall surface of tank 6 and define a different chamber for the non-compatible liquid, as shown in phantom in FIG. 2; this liquid would be drained through outlet 18. The separate chambers for non-compatible liquids are hermetically isolated, so it is not necessary to clean tank 6 whenever car 5 carries either of such liquids.

Bead 10 and the immediately adjacent area 20 of diaphragam 9 contact the inside wall surface of tank 6 in a first vertical plane which generally bisects tank 6 longitudinally. Means for sealing diaphragm 9 against tank 6 includes a plurality of first fastener elements such as studs 21 each of which has one end 22 welded to the wall of tank 6 at spaced intervals and female threads at its other or inner end 23. Studs 21 essentially lie in a second vertical plane that is spaced from but parallel to the first vertical plane that includes diaphragm peripheral area 20. An endless, solid O-ring gasket 24 made from a resilient material has a surface 25 that contacts area 20 of diaphragm 9 outside of the first plane, which does not contain studs 21; when not compressed, gasket 24 has a circular cross section.

An endless abutment 27 made from a strip of flat plate metal is secured to the inside wall surface of tank 6. Abutment 27 extends essentially perpendicularly to such wall surface in a third vertical plane that is spaced from but parallel to the aforementioned first and second planes. The ends 23 of studs 21 extend inwardly beyond the inwardly projecting terminal edge 28 of abutment 27. The terminal edge 11 of bead 10 contacts abutment 27 around the entire periphery of the bead, and a mastic or sealant 30 such as a polysulfide liquid polymer compound may occupy any space between bead 10 and abutment 27. The sealant or mastic 30 also may be applied between area 20 of diaphragm 9 and the wall of tank 6.

A clamp 32 shaped to conform to the inside surface of the wall of tank 6 is made from a series of separate, aligned, independently movable members 33 and 34. Each member 33 has a first arm 35 at one end which contacts an opposite surface 36 of gasket 24. The end of arm 35 is bifurcated into an inverted Y shape. Gasket 24 is compressed and confined in the bifurcated fork or crotch 38 of such Y. Crotch 38 holds gasket 24 away from bead 10 at the peripheral edge of diaphragm 9. Each member 33 has a central portion 39 that is generally parallel to the adjacent surface of the wall of tank 6. Each central portion 39 extends over abutment 27, bead 11 and a plurality of studs 21. Each member 33 also has a second arm 40 at its opposite end which has a terminal edge 41 that contacts but is not attached to the wall of tank 6. First arm 35 is in a plane which intersects the adjacent wall surface of tank 6, and second arm 40 is in another plane which intersects the adjacent tank wall surface, and the planes of arms 35 and 40 intersect each other.

Second threaded fastener elements such as bolts 42 pass through oversized holes 43 in central portion 39 of each clamp member 33 and mate with the threads in studs 21. Tightening or loosening of bolts 42 in the end 23 of studs 21 adjusts the compressive force with which the arm 35 of each independently movable member 33 engages gasket 24 and hence the force exerted by each member 33 in sealing area 30 of diaphragm 9 against the tank wall. Each clamp member is dimensioned so as to be removable through either manway 14 or 15.

Clamp members 34 at heads 8 are identical to members 33 except that members 34 are curved to conform in shape to the inside wall of the heads. The ends 44 of the clamp members 33 and 34 are located as close as possible to each other (i.e. 1/16 to ⅛ inch), and gasket 24 bridges the small gap between ends 44.

It has thus been shown that by the practice of this invention the affixing of abutment 27 to the inside surface of tank 6 beneath clamp 32 enables the terminal edge 11 of diaphragm 9 to be accurately positioned in contact with the abutment to ensure an hermetic seal. Abutment 27 also protects bead 10 from being forced against sharp surfaces on studs 21 or the weldments securing the studs to tank 6. Even though irregularities may occur in the surface of tank 6, abutment 27 provides a uniform wall for holding an uninterrupted layer of mastic 30 between the terminal edge 11 of bead 10 and the tank wall.

While the present invention has been described with reference to particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A container for a fluid material comprising:
   A. a wall enclosing such material;
   B. a flexible diaphragm in said container, said disphragm having an enlarged bead around its entire periphery, said bead and the adjacent area of said diaphragm contacting said wall; and
   C. means for sealing said diaphragm against said wall comprising:
      1. a plurality of first fastener elements each having one end secured to said wall at spaced intervals, said elements essentially lying in a first plane passing through said enclosure;
      2. an endless abutment secured to said wall, said abutment lying in another plane essentially parallel to said first plane, said bead contacting said abutment around its entire periphery;
      3. a clamp having one end compressing said adjacent area of said diaphragm, said clamp extending over said bead, said abutment and said first fastener elements and having an opposite end which contacts said wall; and
      4. second fastener elements mating with said first fastener elements for adjustably holding said clamp in compressing engagement with said adjacent area.

2. The invention defined in claim 1, wherein said abutment is a flat plate extending essentially perpendicularly to said wall.

3. The invention defined in claim 1, wherein said abutment has an inwardly projecting terminal edge, and the other end of each of said first fastener elements extends beyond said terminal edge.

4. The invention defined in claim 1, wherein a sealant is placed between said abutment and said bead.

5. A wheeled vehicle for transporting a plurality of non-compatible liquids, comprising:
   A. a container for such liquids comprising a generally cylindrical tank having a generally horizontal longitudinal axis;
   B. a flexible diaphragm in said tank, said diaphragm having an enlarged bead around its entire periphery, said bead and the adjacent area of said diaphragm contacting the well of said tank in a first plane which generally bisects said tank, said diaphragm alternately lying against opposite portions of said tank so as to define different chambers for such non-compatible liquids; and
   C. means for sealing said diaphragm against said wall, comprising:
      1. a plurality of first fastener elements each having one end secured to said wall at spaced intervals, said elements essentially lying in a second plane that is spaced from but parallel to said first plane;
      2. an endless abutment secured to said wall, said abutment lying in a third plane essentially parallel to said first and second planes, said bead contacting said abutment around its entire periphery;
      3. a series of aligned separate clamps each of which has one end compressing said adjacent area of said diaphragm against said wall, each clamp extending over said bead, said abutment and a plurality of said first fastener elements and having an opposite end which contacts said wall; and
      4. second fastener elements mating with said first fastener elements for adjustably holding said clamps in compressing engagement with said diaphragm, said clamps each being independently movable.

6. The invention defined in claim 5, wherein said abutment is a flat plate extending essentially perpendicularly to said wall.

7. The invention defined in claim 5, wherein said abutment has an inwardly projecting terminal edge, and the other end of each of said first fastener elements extends beyond said terminal edge.

8. The invention defined in claim 5, wherein a sealant is placed between said abutment and said bead.

9. A railroad tank car for transporting a plurality of non-compatible liquids comprising:

A. a container for such liquids comprising a generally cylindrical tank having each of its ends closed by a dished head and a generally horizontal longitudinal axis;

B. a flexible diaphragm in said tank, said diaphragm having an integral enlarged bead arounds its entire periphery, said bead and the adjacent area of said diaphragm contacting the wall of said tank in a first vertical plane which generally bisects said tank longitudinally, said diaphragm alternately lying against opposite portions of said tank so as to define different chambers of such non-compatible liquids; and C. means for sealing said diaphragm against said wall comprising:

1. a plurality of first fastener elements each having one end secured to said wall at spaced intervals, said first fastener elements essentially lying in a second vertical plane that is spaced from but parallel to said first vertical plane;

2. an abutment comprising an endless flat plate secured to said wall, said plate extending essentially perpendicularly to said wall in a third vertical plane spaced from but parallel to said first and second planes, said bead contacting said plate around its entire periphery, said plate having an inwardly projecting terminal edge, the other end of each of said first fastener elements extending beyond said terminal edge, and a sealant occupying any space between said bead and said abutment;

3. a series of aligned, separate, independently movable clamps each of which has an arm at one end compressing said adjacent area of said diaphragm, each clamp having a central portion that is generally parallel to said adjacent surface and extends over said bead, said abutment and a plurality of said studs, each clamp having an arm at its opposite end which contacts said wall; and 4. second fastener elements mating with said first fastener elements for adjustably holding said clamps in compressing engagements with said diaphragm.

* * * * *